US012434799B1

(12) United States Patent
Chaney

(10) Patent No.: US 12,434,799 B1
(45) Date of Patent: Oct. 7, 2025

(54) FOLDING PONTOON RAFT FRAME

(71) Applicant: John Chaney, Portland, OR (US)

(72) Inventor: John Chaney, Portland, OR (US)

( * ) Notice: Subject to any disclaimer, the term of this patent is extended or adjusted under 35 U.S.C. 154(b) by 0 days.

(21) Appl. No.: 19/257,446

(22) Filed: Jul. 1, 2025

(51) Int. Cl.
*B63B 35/36* (2006.01)
*B63B 1/12* (2006.01)

(52) U.S. Cl.
CPC ..... *B63B 35/36* (2013.01); *B63B 1/121* (2013.01)

(58) Field of Classification Search
CPC ..... B63B 35/36; B63B 1/121
See application file for complete search history.

(56) References Cited

U.S. PATENT DOCUMENTS 4,829,926 A * 5/1989 Voelkel ..... B63B 7/02 114/352
5,243,924 A * 9/1993 Mann ..... B63B 13/00 114/364
5,607,330 A * 3/1997 Hanz ..... B63B 7/02 440/5
9,194,152 B1 * 11/2015 Plasencia ..... E04H 15/48

FOREIGN PATENT DOCUMENTS

DE 212021000383 U1 * 1/2023 ..... B63H 16/12

* cited by examiner

*Primary Examiner* — S. Joseph Morano
*Assistant Examiner* — Jovon E Hayes
(74) *Attorney, Agent, or Firm* — Mark S Hubert

(57) ABSTRACT

A pontoon raft frame made of mirror-image right side and left side tubular sections that are connectable to form a rectangular pontoon raft with a front opening in the raft frame for the seated user's legs to fit. Each tubular section is made of a J shaped assembly hinged to a C shaped assembly, that when connected to form the raft frame, can be placed atop of and strapped to a pair of air bladder pontoons by a set of pontoon cradles extending from the inside and outside of the J and C shaped assemblies. A folding seat is slidingly adjustable along a set of seat rails across the joined C shaped assemblies. The design allows for expansion as the assembled raft frame can be connected with other identical pontoon raft frames in a linear fashion and coupled to longer air bladder pontoons.

7 Claims, 9 Drawing Sheets

FOLDING PONTOON RAFT FRAME

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to fishing, and more particularly to portable fishing boat technology.

BACKGROUND

Pontoon rafts have become the go-to watercraft for many fishmen. Not everyone can afford a boat and a vehicle to pull it. Similarly, not everyone wants to fish from shore or can own a canoe for storage purposes. Pontoon fishing rafts are lightweight, comfortable for day long expeditions and are easy to maneuver. Since the pontoons can readily be inflated on site, there is no requirement for a large transport vehicle like a truck or SUV. Designs exist for extendable pontoon rafts that accommodate more than one person and sit atop longer pontoons. However, to date there are limitations in both weight and dimensions that keep these pontoon fishing rafts from being truly portable.

Many fishermen fly to specific regions for the quality of fishing. Often this involves flying and or lengthy backpacking. Each of these make it hard or impossible to bring their trusted fishing pontoon boat along.

Henceforth, a pontoon fishing boat that would be small enough and light enough to be carried on a plane and backpacked into a lake, would fulfill a long felt need in the fishing industry. This new invention utilizes and combines known and new technologies in a unique and novel configuration to overcome the aforementioned problems and accomplish this.

BRIEF SUMMARY

In accordance with various embodiments, a portable pontoon fishing raft that completely fits into its own suitcase and forms an expandable fishing raft is provided.

In one aspect, a foldable pontoon fishing raft with an expandible frame that can accommodate the coupling of other identical frames to sit atop pontoons of various lengths.

In another aspect, a foldable pontoon fishing raft made in mirror image hingeable right side and left side sections, which can be uncoupled and folded for storage.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

DETAILED DESCRIPTION OF CERTAIN EMBODIMENTS

Figure 1:
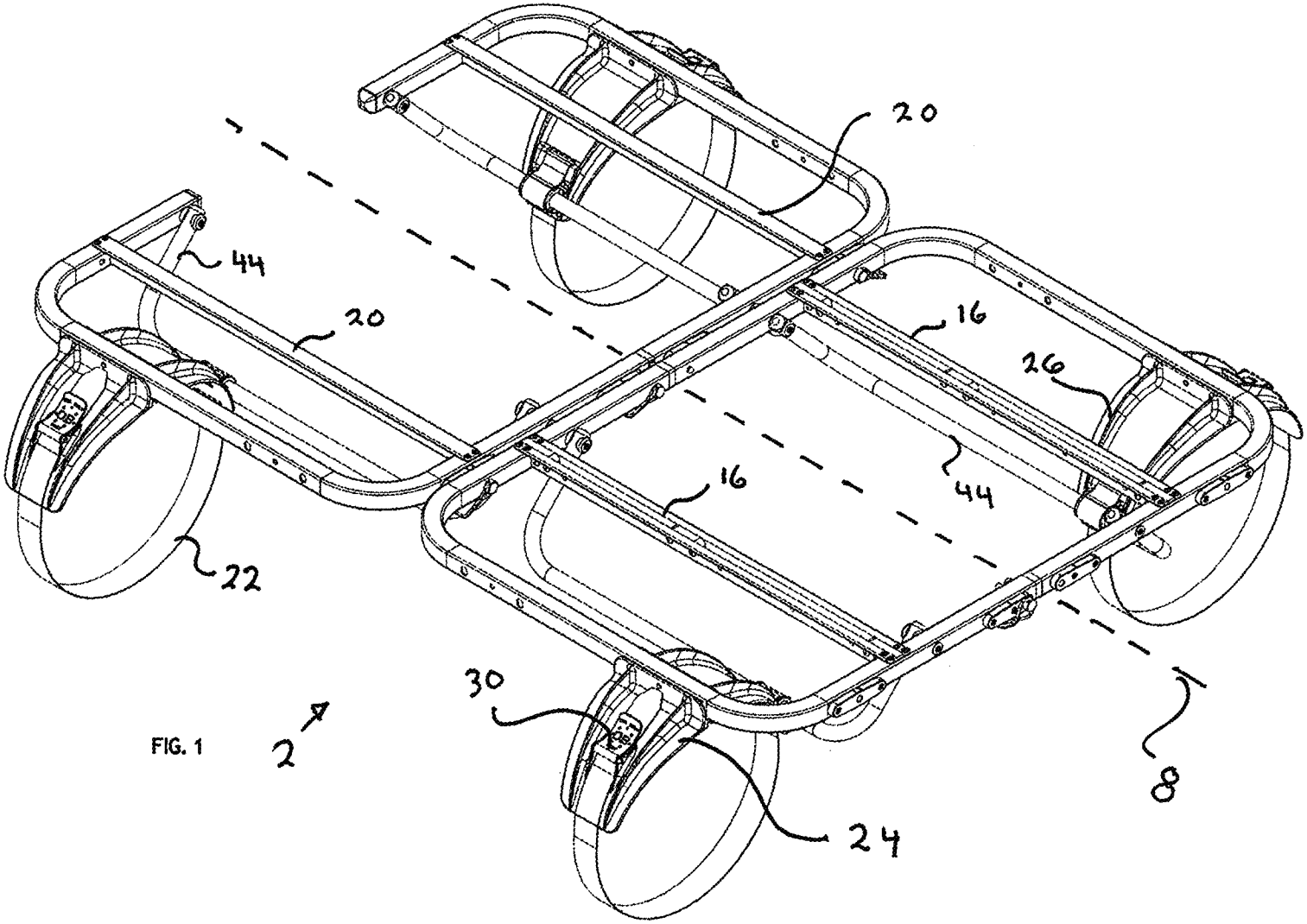
FIG. 1 is a rear perspective view of an assembled pontoon raft frame.
Figure 2:
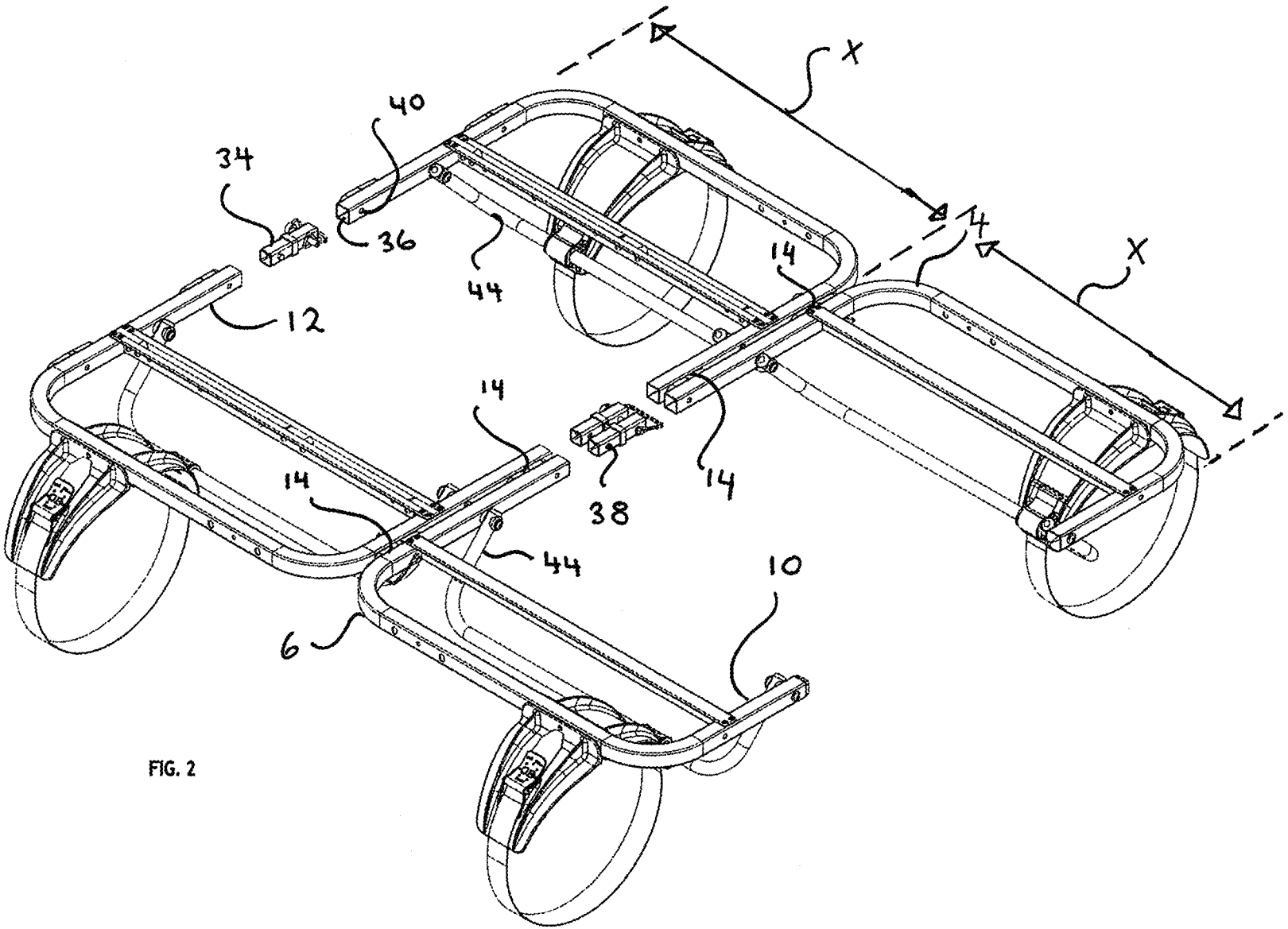
FIG. 2 is a front perspective view of an unassembled pontoon raft frame.
Figure 3:
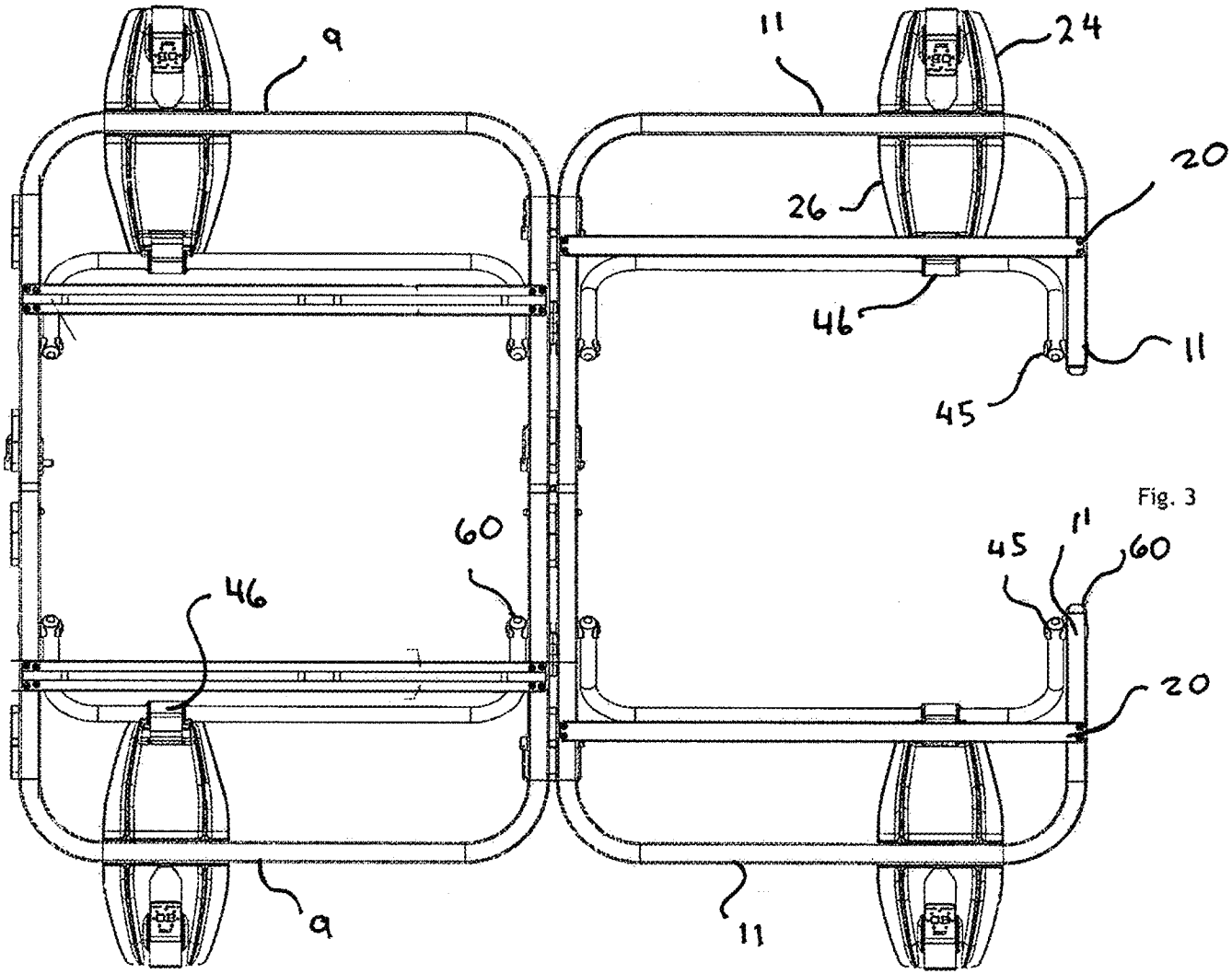
FIG. 3 is a top view of an assembled pontoon raft frame.
Figure 4:
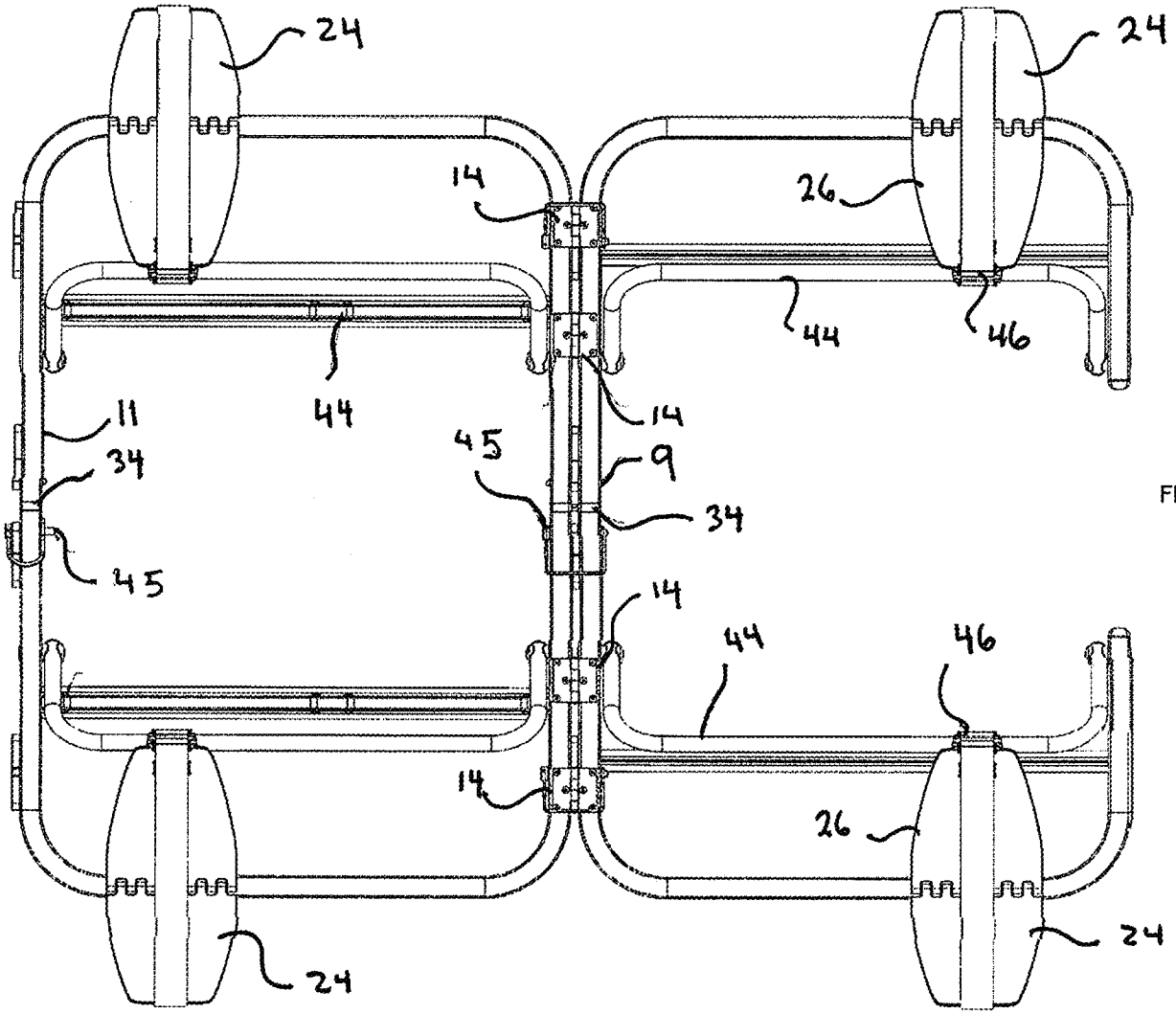
FIG. 4 is a bottom view of an assembled pontoon raft frame.
Figure 5:
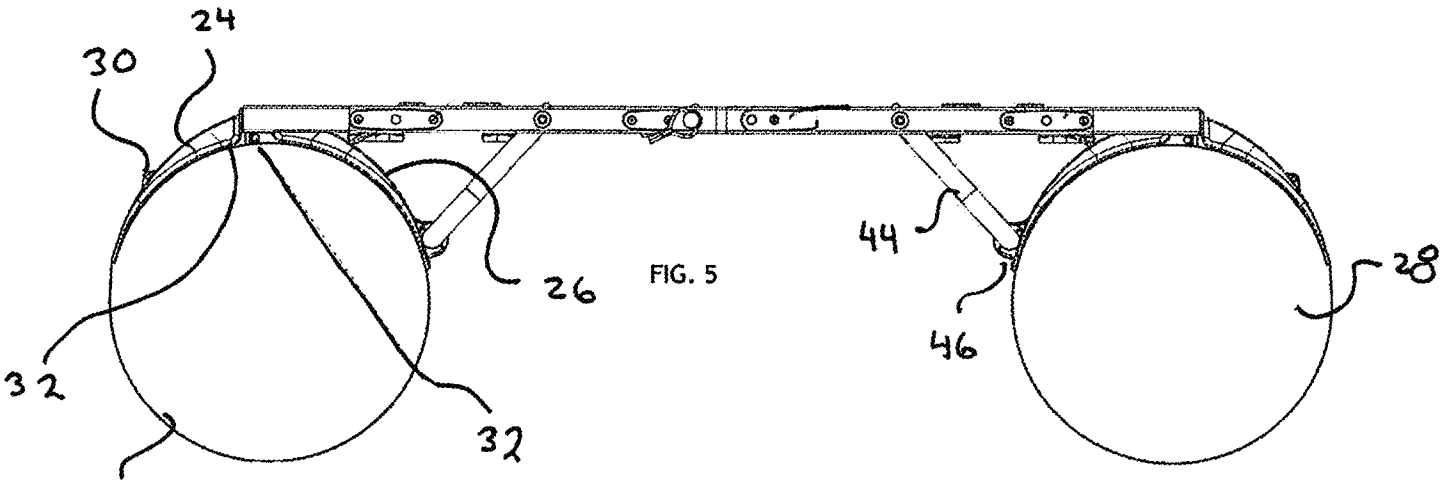
FIG. 5 is a back view of an assembled pontoon raft frame.
Figure 6:
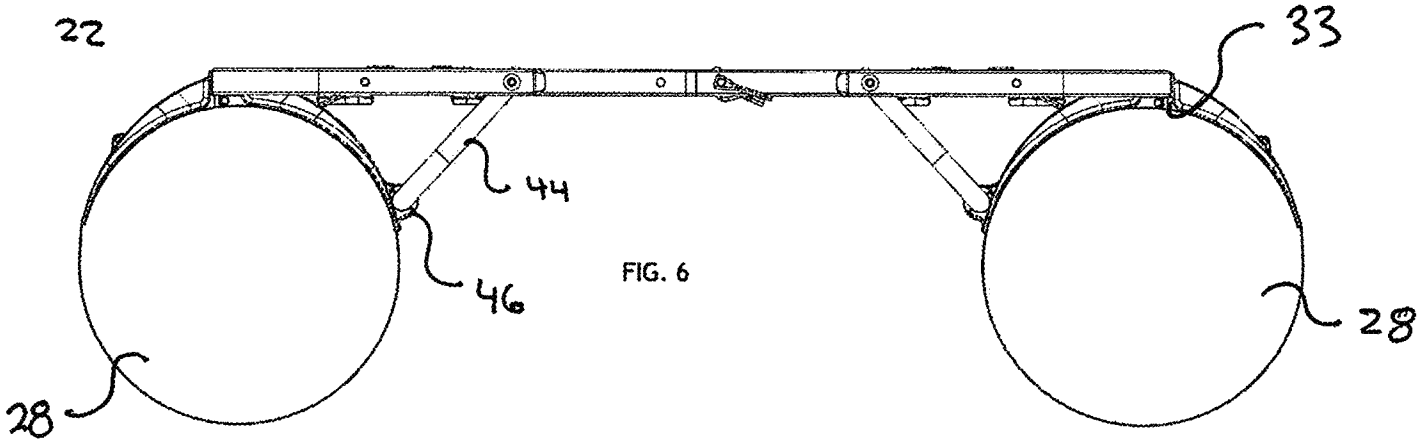
FIG. 6 is a front view of an assembled pontoon raft frame.
Figure 7:
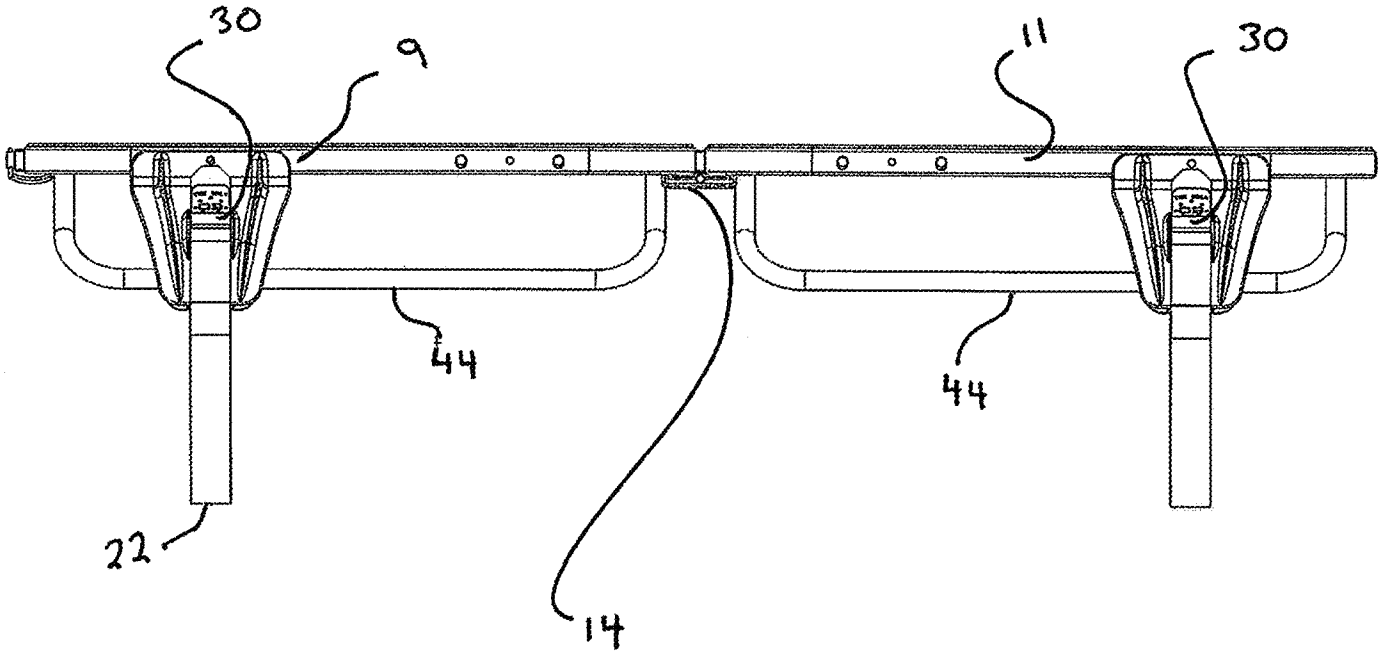
FIG. 7 is a side view of an assembled pontoon raft frame.

While various aspects and features of certain embodiments have been summarized above, the following detailed description illustrates a few exemplary embodiments in further detail to enable one skilled in the art to practice such embodiments. Reference will now be made in detail to embodiments of the inventive concept, examples of which are illustrated in the accompanying drawings. The described examples are provided for illustrative purposes and are not intended to limit the scope of the invention.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

As used in the description of the inventive concept and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

As used herein, the term "outer" refers to any element affixed to the J or C shaped members that extends or projects in a direction away from the center or midpoint of the assembled pontoon raft.

As used herein, the term "outer" refers to any element affixed to the J or C shaped members that extends or projects in a direction toward the center or midpoint of the assembled pontoon raft.

As used herein, the term "C" refers to a C shaped configuration of the element/s it references.

As used herein, the term "J" refers to a J shaped configuration of the element/s it references.

The present invention relates to a novel design for a pontoon raft frame made of connectable, folding right and left side sections, that when connected, can be placed atop of and strapped to a pair of air bladder pontoons. The frame is intended for folded storage in a traveling suitcase sized to house the entire pontoon raft. The frame will reside in the bottom half of the suitcase and the two rip stop nylon inflatable pontoons will reside in the top of the suitcase. This frame design allows for expansion as the assembled raft frame can be connected with other identical pontoon raft frames in a linear fashion and coupled to longer air bladder pontoons such that two or more people can float together.

Looking at FIGS. 1-7 it can be seen that the raft frame 2 is made of a right (or first) side section 4 and a left (or second) side section 6. These sections 4 and 6 are mirror image of each other, taken across the centerline 8 of the raft 2.

Each side section 4 or 6 is made of a J shaped planar front assembly 10 and a C shaped planar rear assembly 12 that are hingedly connected with four pair of hinges 14 along their length sides. These assemblies 10 and 12 are of equal widths as designated by width arrows X on FIG. 2. This allows the J and C assemblies to fold onto each other for storage. In the preferred embodiment these assemblies 10 and 12 are made from square aluminum tubing, however, in alternate embodiments round, oval or rectangular tubing may be used as these are fabricational equivalents.

Figure 8:
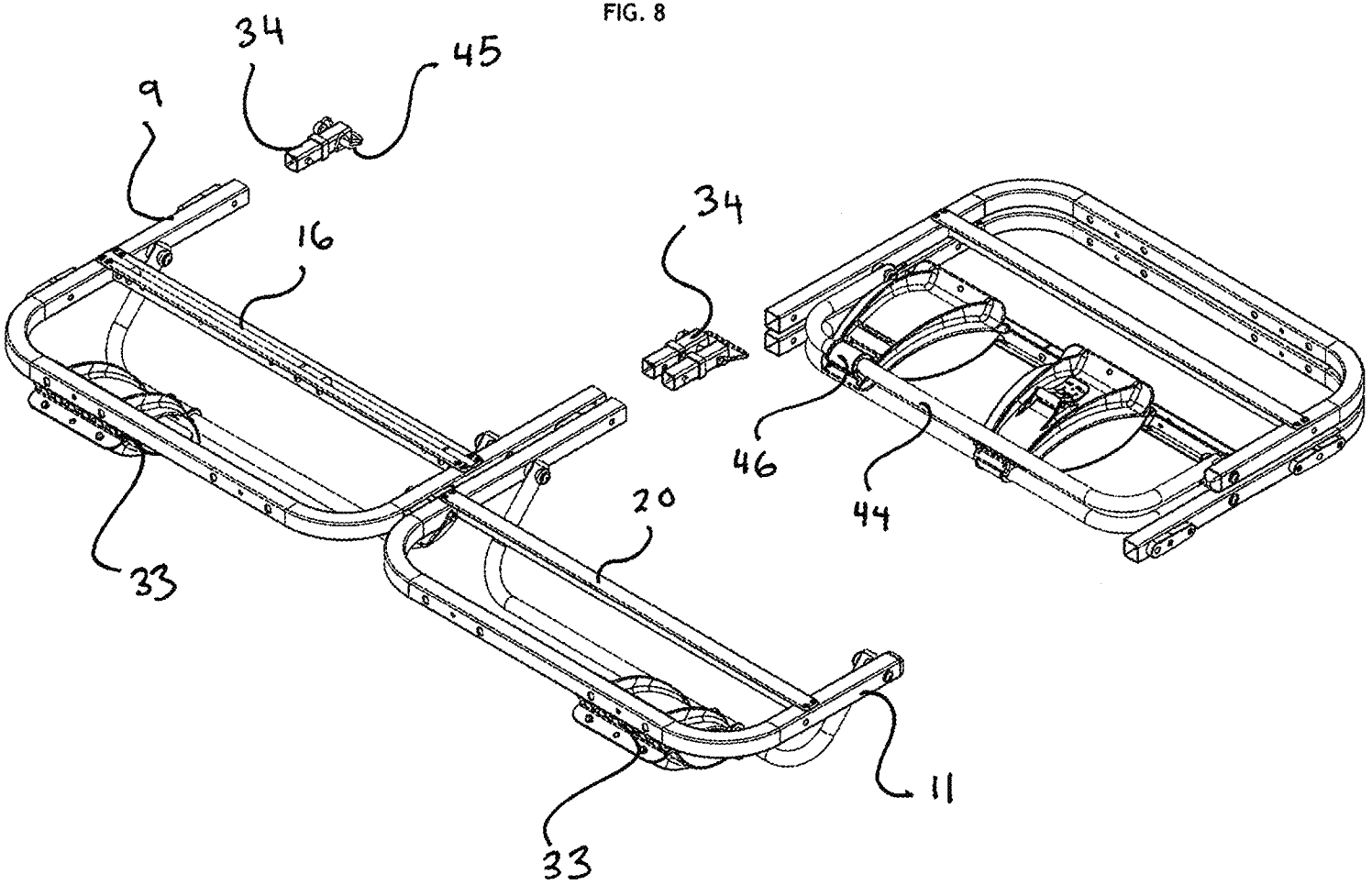
FIG. 8 is a front perspective view of a pontoon raft frame readied for transport.
Figure 11:
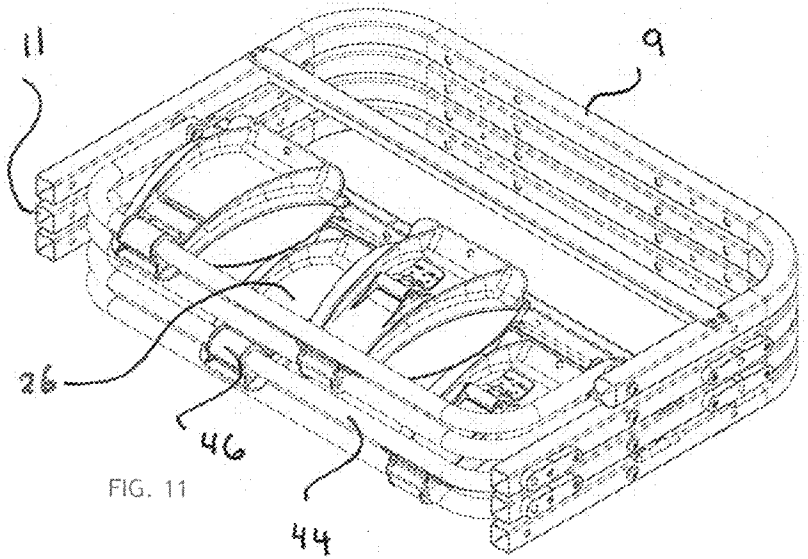
FIG. 11 is a top perspective view of a folded stored pontoon raft frame.
Figure 9:
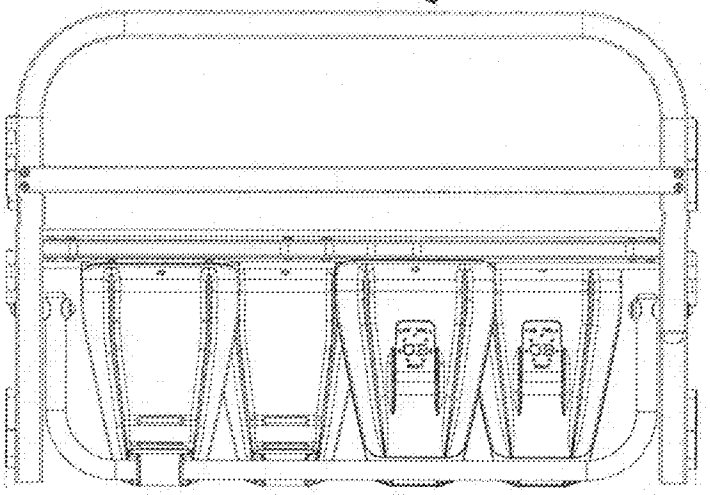
FIG. 9 is a top view of a folded stored pontoon raft frame.
Figure 12:
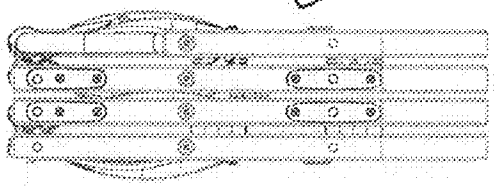
FIG. 12 is a side view of a folded stored pontoon raft frame.
Figure 10:
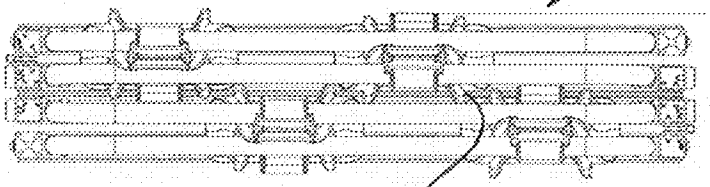
FIG. 10 is an end view of a folded stored pontoon raft frame.

The C assemblies 10 each have a tubular C shaped member 9 with a seat rail 16 affixed across their widths such that they reside parallel when the right and left side sections 4 and 6 are joined. This has two purposes; it strengthens each C assembly 12 preventing it from deviating from its planar configuration, and they form a sliding rail for the seat 18 (FIG. 13) to adjustably move along. There is an outer pontoon tube cradle 24 hingeably attached with a piano style hinge 33 (FIG. 8) to the outer side of the C and J assemblies 10 and 12, and that projects outward, away from the raft's centerline 8 when extended. There is a complimentary inner pontoon tube cradle 26 hingedly attached with cradle hinges 32 to the inner side of the C and J assemblies 10 and 12 and projecting inward, toward the raft's center. The tube cradles 24 and 26 are aligned to form a concave arc that contacts the top of the inflatable pontoon tube 28 (FIG. 13) All of the cradles are arced downward.

A tensionable flexible belt 22 has one end affixed to said inner tube cradle 26 and the other end connectable to a belt cinching mechanism 30 affixed to the outer tube cradle 24. In alternate embodiments the belt 22 may be tensionable in the reverse direction. This is used to encircle the inflatable pontoon tube 28 about its width and compress its diameter slightly to connect the raft frame 2 to the pontoon tubes 28.

The J assemblies 12 each have a tubular J shaped member 11 with a fixed linear member 20 across their widths to increase their rigidity and help maintain their flatness. There is also a pivotable inner cradle support bracket 44 that is pivotally attached by a pin 45 at both its ends so as to lie across the width on the insides of the C members 9 and across the widths of the insides of the J members 11. This pivotable bracket 44 rotationally resides within a tube sleeve 46 extending from the inner pontoon tube cradle 26. This supports the inner pontoon tube cradle 26 when it is fully extended yet allows it to pivot upwards on its hinge for transport. The mirror image J members 11 when joined, unlike the joined C members 9, allow for an opening in front of the seat for the user's feet to pass and to reel in fish without obstruction.

The left and right sections 4 and 6 are connected with three tube plugs 34 that are sized for frictional insertion into the two open tube ends 36 of the C assemblies 12 and the single open tube end 36 of the J assemblies 10. The tube plugs 34 have tube pin orifices formed therethrough that align with frame pin orifices 40 upon full insertion up to the alignment ridge 42 on the plugs 34. Locking pins 45 are used to secure the plugs 34 to the mating sections 4 and 6.

It is to be noted that J and C shaped members 9 and 11 are made of an extruded aluminum or steel, filled with a closed cell foam. The summation of the enclosed volume of the C and J shaped members 9 and 11 exerts enough of a buoyancy effect to ensure the raft 2 will float in water. There are endcaps 60 inserted to close the ends of all the C and J members 9 and 11 to prevent damage from any sharp edges.

Looking at FIGS. 8-12 the folding feature of the raft 2 can best be explained. Disassembly is accomplished in the following manner. The cinching member 30 disengages the belt 22 on all four of the tube cradles (both inner and outer) such that the raft 2 may be lifted off of the inflatable pontoons 28. The seats 18 are slid off of the seat rail 16 and removed. The locking pins 45 are withdrawn from the J and C members 9 and 11 and the tube plugs 34 are removed from the two open tube ends 36 of the C assemblies 12 and the single open tube end 36 of the J assemblies 10. This separates the right and left side sections 4 and 6. The outer pontoon tube cradle 24 is folded on its hinge toward the inside of the C and J members 9 and 11 so as to reside in the same plane as the J and C elements 9 and 11. The inner cradle support bracket 44 is pivoted upward so as to rotate within the tube sleeve 46 and pivot the inner pontoon tube cradle 26 into planar alignment with the J and C members 9 and 11 of the respective. The J and the C members 9 and 11 of each the right and left side sections 4 and 6, are folded atop on another about their respective four hinges 14. The folding seats 18 have their seat backs 72 folded flat. The folded right and left side sections 4 and 6 are placed atop each other. (FIGS. 9-12) Since the inflatable pontoons are made of rip stop nylon with rubber liners, they are deflated and compressed end for end and may be placed atop the stacked, folded right and left sections. This may be sealed in the stacked configuration into a traveling suitcase. Assembly follows the reverse operation.

Figure 13:
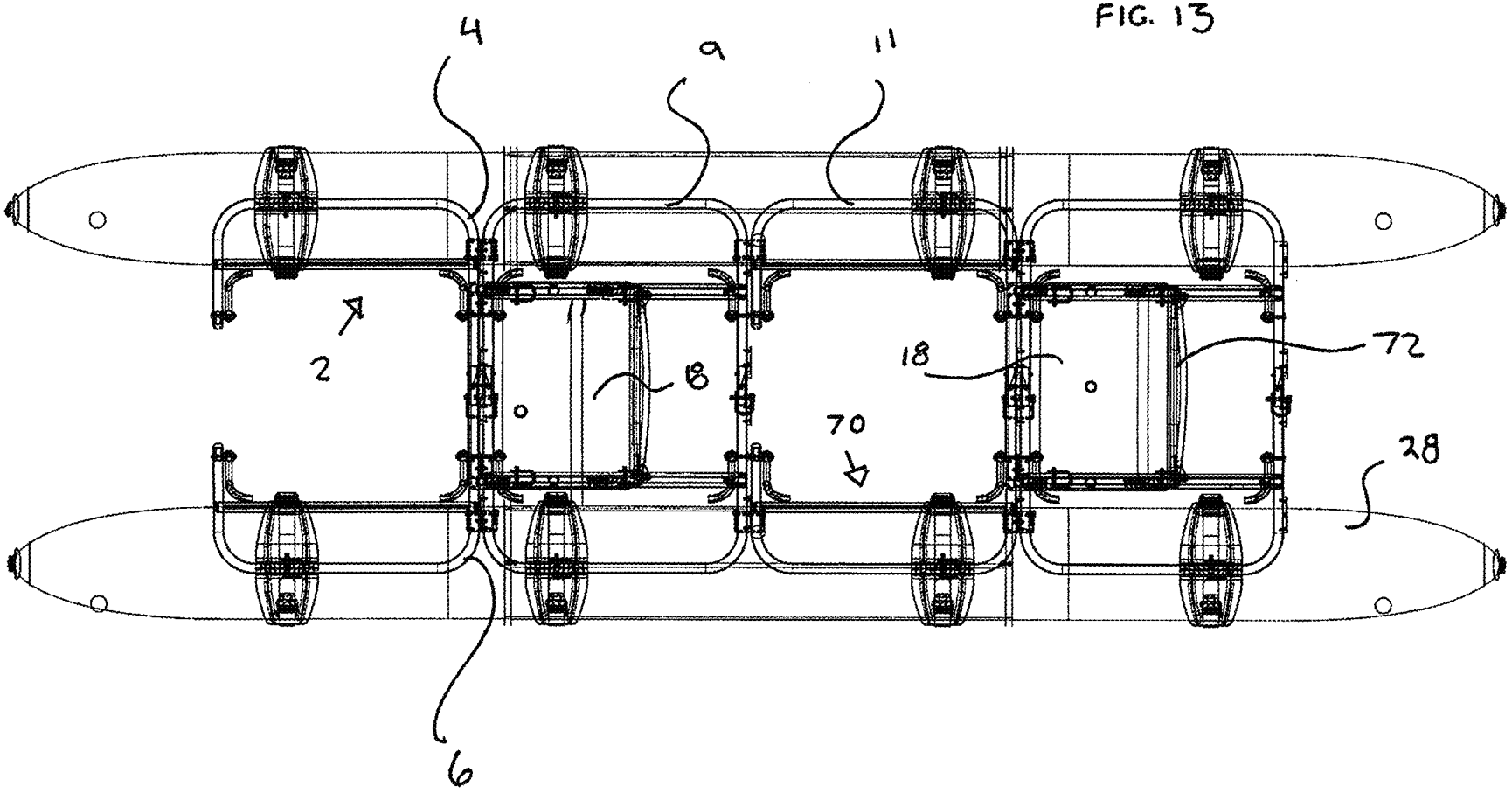
FIG. 13 is a top view of a a two-person pontoon raft.

FIG. 13 illustrates how the raft frame 2 can be adjoined to a second raft frame 70. The unfolded C members 9 of the first raft frame 2 are pinned together with the unfolded J members 11 of the second raft frame 70 to form planar right and left sections 4 and 6.

Having described and illustrated the principles of the inventive concept with reference to the illustrated embodiment, it will be recognized that the illustrated embodiment can be modified in arrangement and detail without departing from such principles. And although the foregoing discussion has focused on particular embodiments, other configurations are contemplated. While certain features and aspects have been described with respect to the exemplary embodiment, one skilled in the art will recognize that numerous modifications are possible.

Consequently, this detailed description and accompanying material is intended to be illustrative only, and should not be taken as limiting the scope of the inventive concept. What is claimed as the invention, therefore, is all such modifications as may come within the scope and spirit of the following claims and equivalents thereto.

Having thus described the invention, what is claimed as new and desired to be secured by Letters Patent is as follows:

1. A folding pontoon raft frame, comprising:

a right-side section comprised of a first front planar, J shaped member hingedly connected to a first rear planar C shaped member;

a left-side section comprised of a second front planar, J shaped member hingedly connected to a second rear planar C shaped member and wherein said left-side section is a mirror image configuration of said right-side section;

at least three tube plugs, two of which are frictional engageable between said first rear planar C shaped member and said second rear planar C shaped member, and one of which is engageable between said first front planar, J shaped member and said second front planar, J shaped member;

at least three locking pins, two engageable with two of said three tube plugs and said rear planar C shaped members, and one engageable with one of said three tube plugs and said front planar J shaped members;

a pontoon tube cradle from a set of four pontoon tube cradles, each one attached to either one of said C shaped members or one of said J shaped members;

a flexible, cinchable belt extending from each of said pontoon tube cradles; and wherein said raft frame has a centerline that separates said right-side section from said left-side section.

2. The folding pontoon raft frame of claim 1, wherein said J shaped and said C shaped members are tubular members made of a material selected from the group consisting of aluminum and steels, wherein said tubular members have a cumulative inner volume that can provide a buoyance force in water that exceeds a weight of all said tubular members.

3. The folding pontoon raft frame of claim 1 further comprising:

a first fixed seat rail across said first rear planar C shaped member;

a second fixed seat rail across second rear planar C shaped member; and a folding seat slidingly attached to said first and second fixed seat rails.

4. The folding pontoon raft frame of claim 1, wherein each said pontoon tube cradle is comprised of:

an outer tube pontoon cradle hingedly attached to each of said C and J shaped members and projecting outward from a centerline of said raft frame's centerline when extended, and an inner pontoon tube cradle hingedly attached to said each of C and J shaped members and projecting inward toward said raft frame's centerline when extended.

5. The folding pontoon raft frame of claim 3 further comprising:

a first pontoon tube cradle support pivotally attached across said first J shaped member and rotationally passing through a first pontoon tube sleeve mounted on a first inner pontoon tube cradle bracket;

a second pontoon tube cradle support pivotally attached across said second J shaped member and rotationally passing through a second pontoon tube sleeve mounted on a second inner pontoon tube cradle bracket;

a third pontoon tube cradle support pivotally attached across said first C shaped member and rotationally passing through a third pontoon tube sleeve mounted on a third inner pontoon tube cradle bracket;

a fourth pontoon tube cradle support pivotally attached across said second C shaped member and rotationally passing through a fourth pontoon tube sleeve mounted on a fourth inner pontoon tube cradle bracket.

6. The folding pontoon raft frame of claim 2, wherein said tubular members are foam filled.

7. The folding pontoon raft frame of claim 2, further comprising:

two fixed linear members, each one of which is affixed across one of said J shaped members.

* * * * *